US010455909B2

(12) United States Patent
Hwang

(10) Patent No.: US 10,455,909 B2
(45) Date of Patent: Oct. 29, 2019

(54) POLE SHAFT DEVICE

(71) Applicant: Sun Ho Hwang, Jeju-si (KR)

(72) Inventor: Sun Ho Hwang, Jeju-si (KR)

( * ) Notice: Subject to any disclaimer, the term of this patent is extended or adjusted under 35 U.S.C. 154(b) by 0 days.

(21) Appl. No.: 15/562,376

(22) PCT Filed: Mar. 24, 2016

(86) PCT No.: PCT/KR2016/002994
§ 371 (c)(1),
(2) Date: Sep. 27, 2017

(87) PCT Pub. No.: WO2016/159569
PCT Pub. Date: Oct. 6, 2016

(65) Prior Publication Data

US 2018/0279726 A1 Oct. 4, 2018

(30) Foreign Application Priority Data

Apr. 1, 2015 (KR) ..... 10-2015-0045947

(51) Int. Cl.

| | |
|---|---|
| ***A45B 3/12*** | (2006.01) |
| ***A45B 1/00*** | (2006.01) |
| ***A45B 7/00*** | (2006.01) |
| ***A45B 3/00*** | (2006.01) |
| ***A45B 9/00*** | (2006.01) |

(52) U.S. Cl.
CPC ..... *A45B 1/00* (2013.01); *A45B 3/00* (2013.01); *A45B 7/00* (2013.01); *A45B 9/00* (2013.01); *A45B 2009/005* (2013.01); *A45B 2009/007* (2013.01); *A45B 2200/05* (2013.01); *A45B 2200/10* (2013.01)

(58) Field of Classification Search
CPC ..... A45B 9/00; A45B 3/12; A45B 2200/05; A45B 7/00; A45B 2009/007; Y10T 403/557; Y10T 403/70; Y10T 403/7047; F16B 7/10
USPC ..... 135/115, 65–66, 69, 75, 84; 248/188.5, 248/412, 414; 403/109.1, 109.5, 370, 403/371, 379.6
See application file for complete search history.

(56) References Cited

U.S. PATENT DOCUMENTS 2,915,327 A * 12/1959 Kreske ..... F16B 7/1463 403/104
2,947,556 A * 8/1960 Wenger ..... F16B 7/1463 108/147.19

(Continued)

FOREIGN PATENT DOCUMENTS

JP 3028166 U 6/1996
KR 20-0282354 Y1 7/2002

(Continued)

*Primary Examiner* — Winnie Yip
(74) *Attorney, Agent, or Firm* — Heedong Chae; Lucem, PC

(57) ABSTRACT

The present invention provides a pole shaft device including an outer shaft (10); an inner shaft (20) which is disposed in the outer shaft (10) and slides along the inside of the outer shaft (10); a fixing member (30) which is fixed on the inner shaft (20) and has an inclined surface formed in the circumferential direction thereof; and an extension member (40) which is coupled to the outer shaft (10) so as to be movable in the longitudinal direction thereof, and is extended by friction with the inclined surface so as to fix the outer shaft (10) and the inner shaft (20).

4 Claims, 10 Drawing Sheets

(56) References Cited

U.S. PATENT DOCUMENTS

| | | | | | |
|---|---|---|---|---|---|
| 3,515,418 | A | | 6/1970 | Nielsen, Jr. | |
| 4,134,703 | A | * | 1/1979 | Hinners | A63C 11/221 248/188.5 |
| 4,238,164 | A | * | 12/1980 | Mazzolla | B05C 17/0205 403/109.5 |
| 4,856,929 | A | * | 8/1989 | Smahlik | A47L 1/06 403/297 |
| 5,458,427 | A | * | 10/1995 | Simond | A63C 11/221 280/820 |
| 6,027,087 | A | * | 2/2000 | Lindemann | A63C 11/221 248/188.5 |
| 8,479,932 | B2 | * | 7/2013 | Carney | A47H 1/022 211/105.5 |
| 8,967,170 | B1 | * | 3/2015 | Lai | A45B 9/00 135/75 |
| 2006/0204322 | A1 | * | 9/2006 | Roiser | A45B 9/00 403/109.5 |
| 2015/0320159 | A1 | * | 11/2015 | Heim | A63C 11/221 135/75 |

FOREIGN PATENT DOCUMENTS

| | | | |
|---|---|---|---|
| KR | 20-0299557 | Y1 | 1/2003 |
| KR | 20-0340353 | Y1 | 2/2004 |
| KR | 10-2005-0026734 | A | 3/2005 |
| KR | 10-2012-0055762 | A | 6/2012 |
| KR | 20-2012-0007253 | U | 10/2012 |

* cited by examiner

POLE SHAFT DEVICE

CROSS-REFERENCE TO RELATED APPLICATION

This application claims the benefit of Korean Application No. 10-2014-0150117 filed on Oct. 31, 2014 with the Korean Intellectual Property Office, the disclosure of which is incorporated herein by reference

TECHNICAL FIELD

The present invention relates to a pole shaft device and more particularly, to a pole shaft device capable of simply adjusting a length.

BACKGROUND ART

Recently, people which recharge vitality of the life which enjoying working, climbing, and the like outdoors away from the busy life and do leisure activities that help their health are increasing day by day, and since the people walk outdoors for a long time, a stick has been widely used as a walking aid even in a flat area as well as climbing.

A device such as the stick is configured by a plurality of shafts to adjust a length according to a user's height.

However, after an existing stick which is adjustable in length has a problem that a slip occurs by a load when a strong load is applied after adjusting the length.

PRIOR ART DOCUMENT

Patent Document

Korean Patent Publication No. 10-2012-0055762

DISCLOSURE

Technical Problem

The present invention has been made in an effort to a pole shaft device capable of simply adjusting a length and firmly supporting a load even against strong external force.

Technical Solution

An exemplary embodiment to the present invention provides a pole shaft device including: an outer shaft 10; an inner shaft 20 which is disposed in the outer shaft 10 and slides along the inside of the outer shaft 10; a fixing member 30 which is fixed on the inner shaft and has an inclined surface formed in the circumferential direction thereof; and an extension member 40 which is coupled to the outer shaft 10 so as to be movable in the longitudinal direction thereof, and is extended by friction with the inclined surface so as to fix the outer shaft 10 and the inner shaft 20.

The fixing member 30 may include a fixing body 32; an inner fixing portion 34 which is formed in the fixing body 32, inserted to an inner hollow 21, and coupled with the inner shaft 20; and an inclined surface 35 which is formed on the fixing body 32, formed in a circumferential direction thereof, installed with the extension member 40, and interferes with the extension member 40 during rotation to press the extension member 40.

The pole shaft device may further include a stop ring 38 which is installed on the fixing member 30 and prevents the extension member 40 from moving in the longitudinal direction to prevent the extension member 40 from being separated from the fixing member 30.

A plurality of inclined surfaces 35 may be formed, an inclined end 36 may be between the inclined surfaces 35, the inclined end 36 may have a height difference, and the extension member 40 may interlock with the inclined end 36 when the fixing member 30 rotates.

The extension member 40 may include a slide protrusion 42 which is coupled to an outer groove 12 formed in the longitudinal direction of the outer shaft 10; and an extension locking portion 46 interlocking with the inclined end 36.

The extension member 40 may be formed with a bending pattern 41 formed by bending in a vertical direction.

Advantageous Effects

According to the present invention, since the inclined surface of the fixing member and the extension member interfere with each other so as to extend the extension member when the outer shaft or the inner shaft is relatively rotated, the pole shaft device has effects of conveniently fixing the outer shaft and the inner shaft.

The pole shaft device according to the present invention has effects of minimizing components for selectively fixing the outer shaft and the inner shaft.

The pole shaft device according to the present invention has effects of limiting a maximum load which is applied to the extension member by the fixing member through the inclined surface and preventing the extension member from being broken.

The pole shaft devices according to the present invention have effects of being connected in multiple stages by replacing connection parts.

MODES OF THE INVENTION

Figure 1:
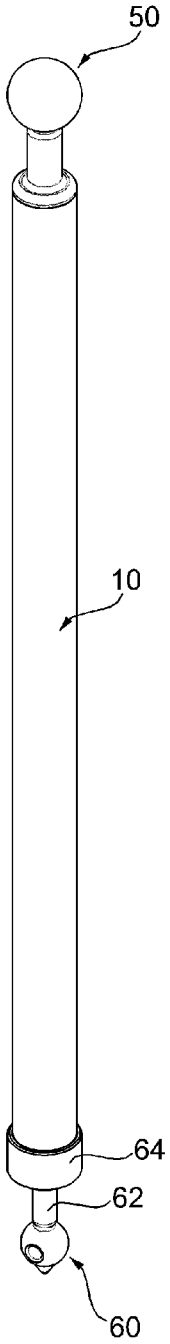
FIG. 1 is a perspective view of a pole shaft device according to a first exemplary embodiment of the present invention.

Hereinafter, the present invention will be described in detail with reference to the accompanying drawings.

However, in the following description, a detailed explanation of known related technologies may be omitted to avoid unnecessarily obscuring the subject matter of the present invention. It is noted that even if the terms are the same, when displayed parts are different, reference numerals do not coincide with each other.

In addition, it is understood that since terms to be described below are terms set by considering functions in the present invention and vary according to intention of users such as an experimenter and a measurer or practices, the definition thereof should be based on the contents throughout this specification.

Terms such as first, second, and the like may be used to describe various components and the components should not be limited by the terms. The terms are used only to discriminate one constituent element from another component. For example, a first component may be referred to as a second component, and similarly, the second component may be referred to as the first component without departing from the scope of the present invention. A term 'and/or' includes a combination of a plurality of associated disclosed items or any item of the plurality of associated disclosed items.

Terms used in the present application are used only to describe specific exemplary embodiments, and are not intended to limit the present invention. A singular form may include a plural form if there is no clearly opposite meaning in the context.

If it is not contrarily defined, all terms used herein including technological or scientific terms have the same meanings as those generally understood by a person with ordinary skill in the art. Terms defined in generally used dictionary shall be construed that they have meanings matching those in the context of a related art, and shall not be construed in ideal or excessively formal meanings unless they are clearly defined in the present application.

Throughout the specification, unless explicitly described to the contrary, the word "comprise" and variations such as "comprises" or "comprising" will be understood to imply the inclusion of stated elements but not the exclusion of any other elements.

Hereinafter, detailed exemplary embodiments of the present invention will be described with reference to the accompanying drawings.

Figure 2:
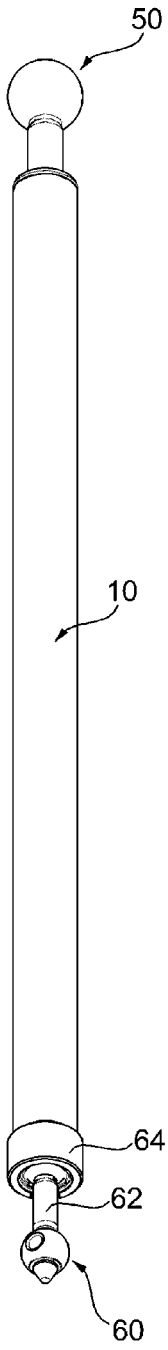
FIG. 2 is a perspective view from the lower side of FIG. 1.
Figure 3:
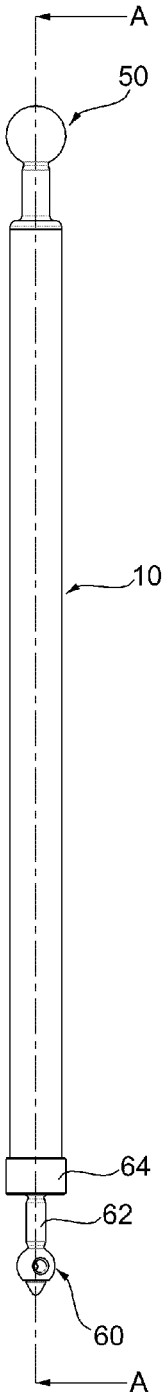
FIG. 3 is a front view of FIG. 1.
Figure 4:
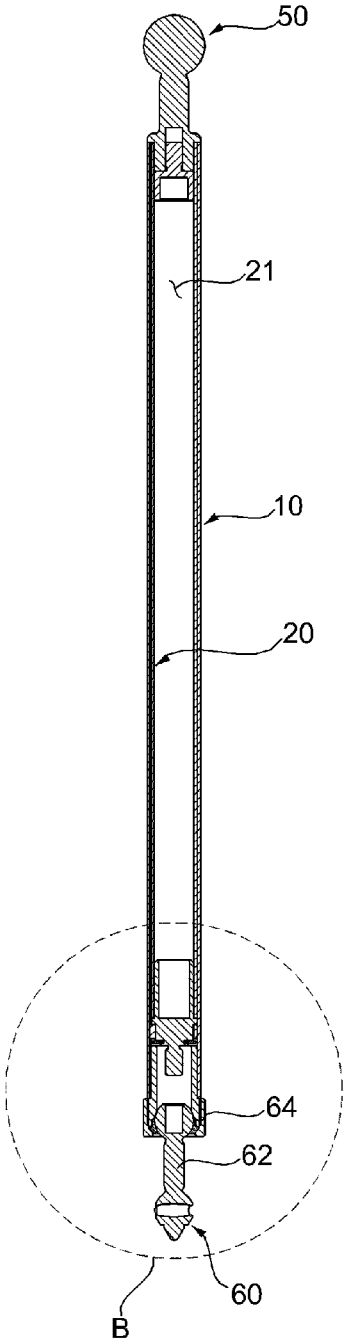
FIG. 4 is a cross-sectional view taken along the line A-A of FIG. 3.
Figure 5:
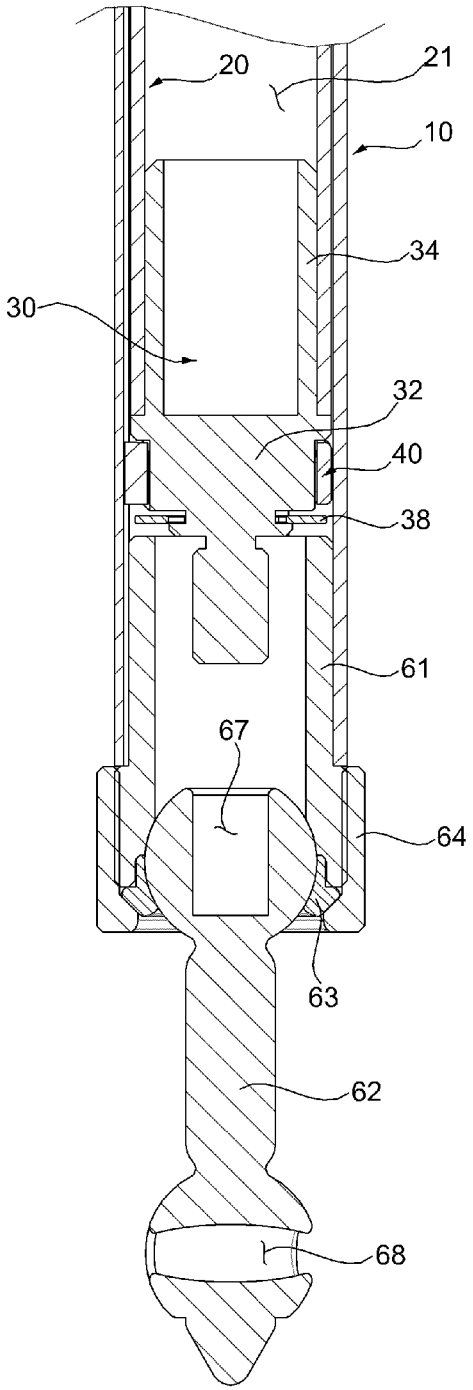
FIG. 5 is a detailed view of B illustrated in FIG. 4.
Figure 6:
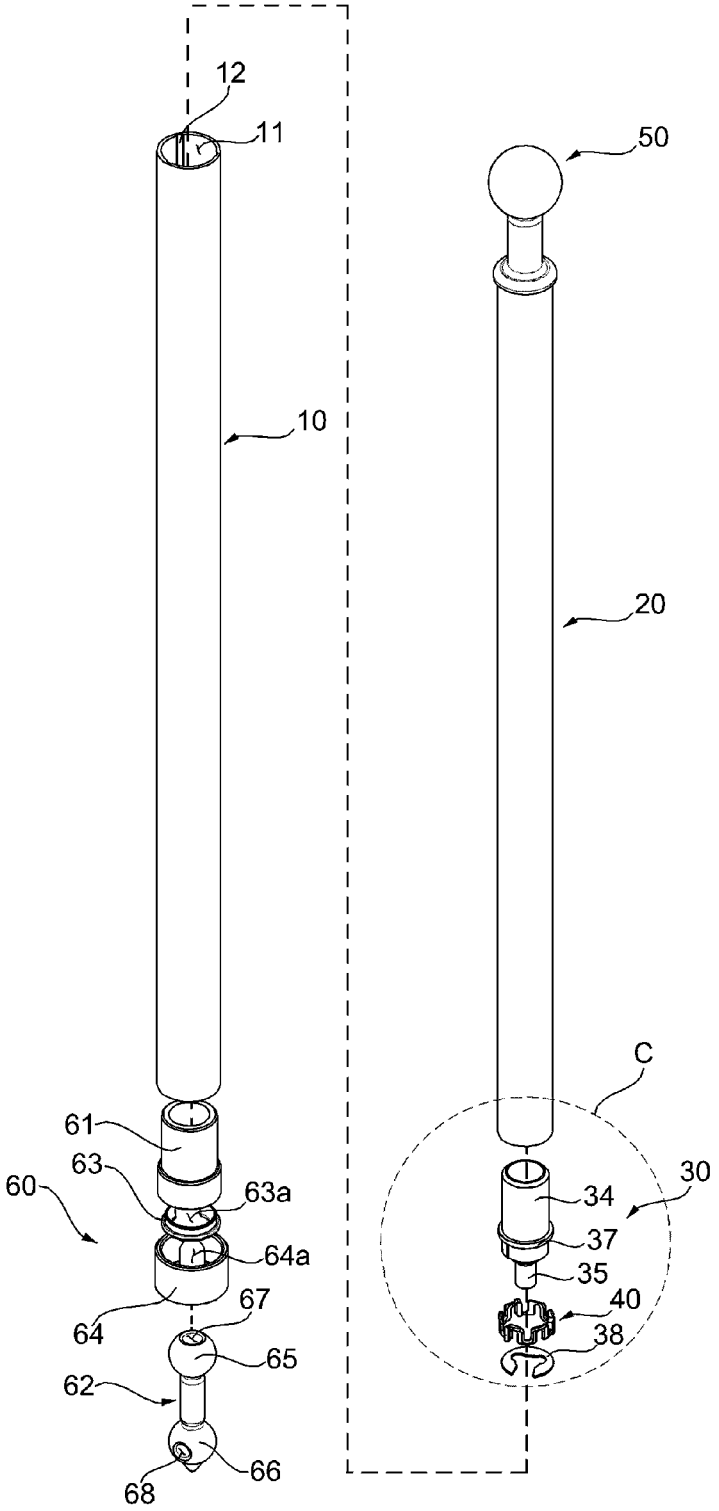
FIG. 6 is an exploded perspective view of FIG. 1.
Figure 7:
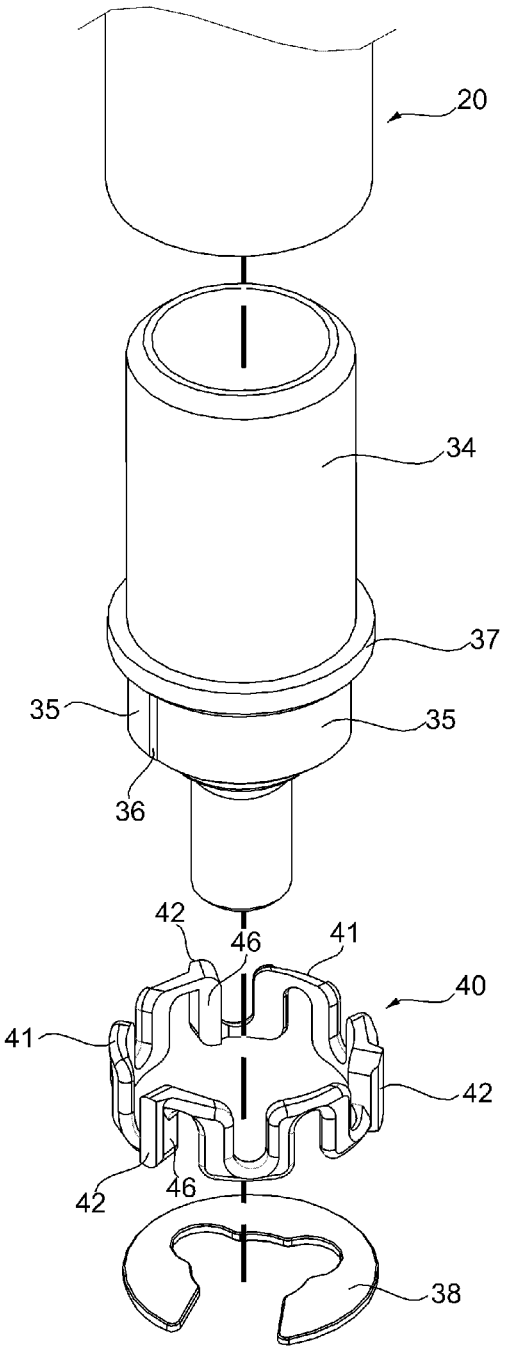
FIG. 7 is a detailed view of C illustrated in FIG. 6.
Figure 8:
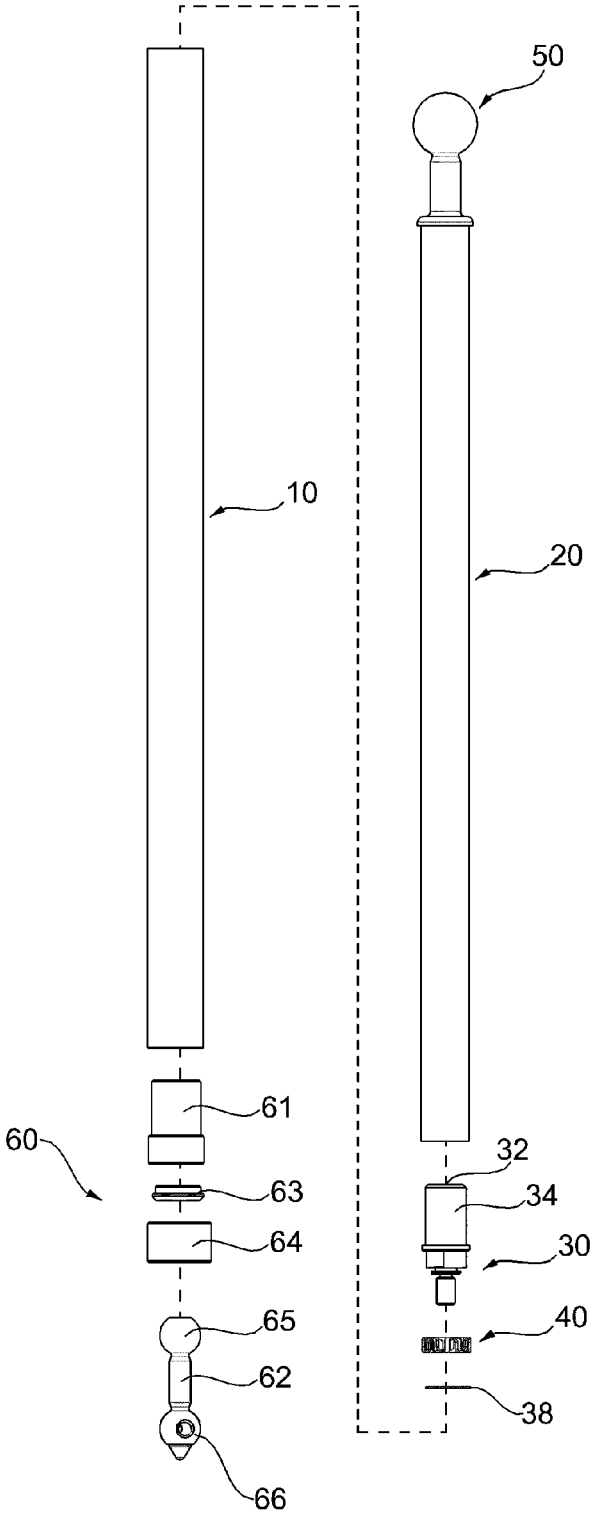
FIG. 8 is a front view of FIG. 6.
Figure 9:
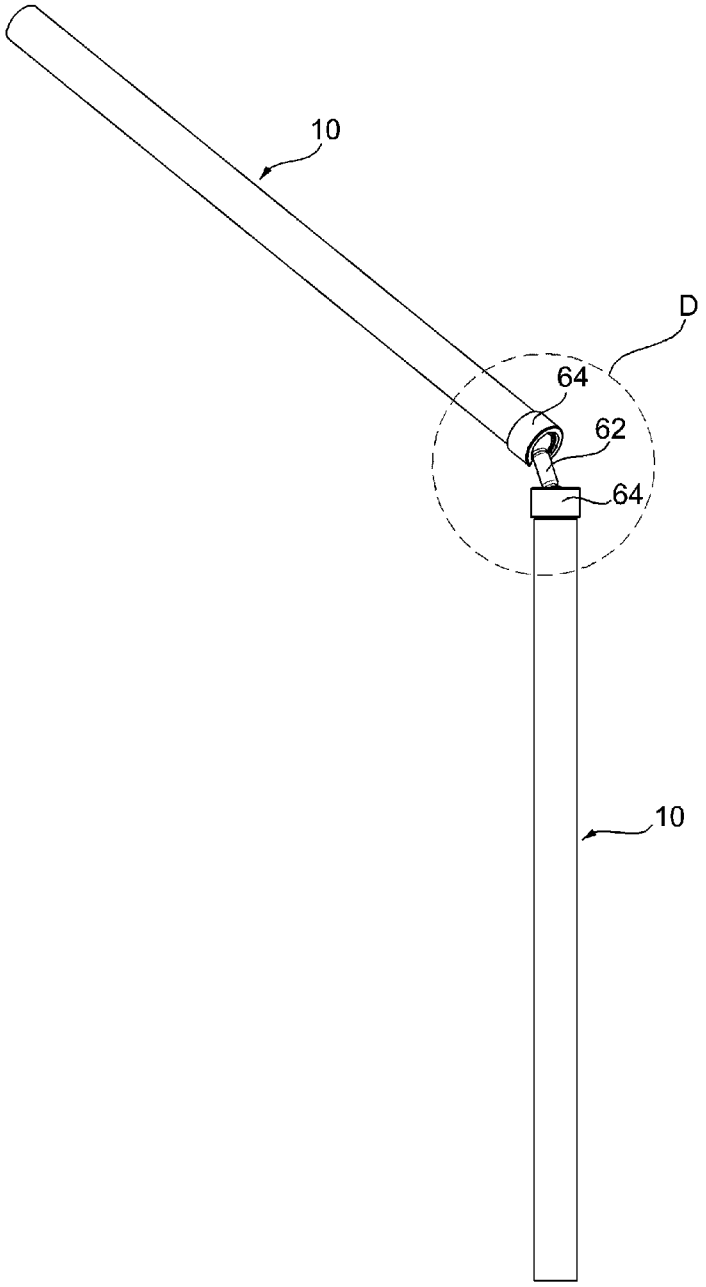
FIG. 9 is a front view illustrating a coupling state of the pole shaft devices according to the first exemplary embodiment.
Figure 10:
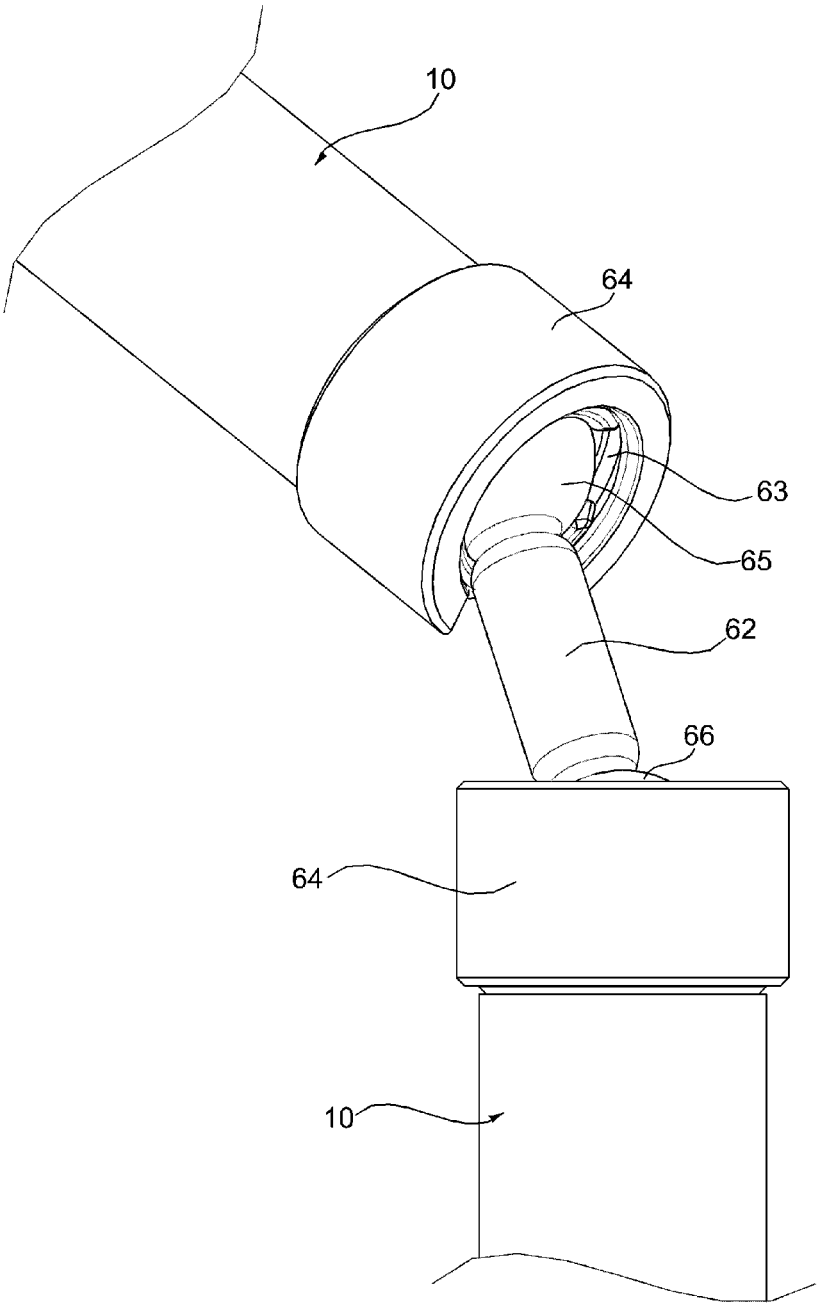
FIG. 10 is a detailed view of D illustrated in FIG. 9.

FIG. 1 is a perspective view of a pole shaft device according to a first exemplary embodiment of the present invention, FIG. 2 is a perspective view from the lower side of FIG. 1, FIG. 3 is a front view of FIG. 1, FIG. 4 is a cross-sectional view taken along the line A-A of FIG. 3, FIG. 5 is a detailed view of B illustrated in FIG. 4, FIG. 6 is an exploded perspective view of FIG. 1, FIG. 7 is a detailed view of C illustrated in FIG. 6, FIG. 8 is a front view of FIG. 6, FIG. 8 is a front view of FIG. 6, FIG. 9 is a front view illustrating a coupling state of the pole shaft devices according to the first exemplary embodiment, and FIG. 10 is a detailed view of D illustrated in FIG. 9.

A pole shaft device according to an exemplary embodiment of the present invention includes an outer shaft 10, an inner shaft 20 which is disposed in the outer shaft 10 and slides along the inside of the outer shaft 10, a fixing member 30 which is fixed on the inner shaft 20, and an extension member 40 which is coupled to the outer shaft 10 so as to move in the longitudinal direction thereof and is extended by the rotation of the fixing member 30 to fix the outer shaft 10.

An outer hollow 11 is formed in the outer shaft 10.

The inner shaft 20 is inserted to the outer hollow 11.

An outer groove 12 is formed on the inner surface of the outer shaft 10 in a longitudinal direction.

A plurality of outer grooves 12 may be formed.

In the exemplary embodiment, the extension member 40 is coupled with the outer groove 12.

A part of the extension member 40 is inserted to the outer groove 12 to slide in a longitudinal direction.

Since the part of the extension member 40 is inserted to the outer groove 12, the extension member 40 interlocks with the outer groove 12 in a circumferential direction and does not rotate.

An inner hollow 21 is formed in the inner shaft 20.

In the exemplary embodiment, the outer shaft 10 and the inner shaft 20 are names for describing operations, and as illustrated in the drawings, when three shafts are disposed, a middle shaft performs both a function of the outer shaft and a function of the inner shaft.

The fixing member 30 includes a fixing body 32, an inner fixing portion 34 which is formed in the fixing body 32, inserted to the inner hollow 21, and coupled with the inner shaft 20, a fixing stopper 37 which interlocks with the inner shaft 20 to limit an insertion depth, and an inclined surface 35 which is formed on the fixing body 32 and installed with the extension member 40.

In the fixing member 30, the inner fixing portion 34 is fixed to the inner shaft 20. In the exemplary embodiment, the inner fixing portion 34 is engaged with the inner shaft 20.

The fixing stopper 37 limits a depth at which the fixing member 30 is inserted to the inner shaft 20.

The inclined surface 35 interferes with the extension member 40 in a rotation direction. In the exemplary embodiment, when the inclined surface 35 rotates clockwise, the extension member 40 is extended to the outside in a radial direction.

When the inclined surface 35 rotates counterclockwise, the interference between the inclined surface 35 and the extension member 40 is released.

When the extension member 40 is extended, the inner shaft 20 and the outer shaft 10 are fixed.

When the extension member 40 is restored to an original state, the outer shaft 10 and the inner shaft 10 may freely slide to each other.

In the exemplary embodiment, three inclined surfaces 35 are formed in a circumferential direction of the fixing body 32.

The inclined surfaces 35 are disposed at intervals of 120° based on an axial center.

Then, in the exemplary embodiment, the inclined end 36 is formed between the inclined surfaces 35.

The inclined surface 35 may be formed in a flat surface, but may be formed in a curved surface in the exemplary embodiment.

When the fixing member 30 rotates clockwise, the extension member 40 is pushed by the inclined surface 35 to be bent to the outside in a radial direction.

The extension member 40 is bent in an elastic range.

When the pressing by the inclined surface 35 is released, the extension member 40 is restored to the original state.

The extension member 40 is formed in a ring shape.

In the extension member 40, vertically bent patterns are repeated.

In the exemplary embodiment, the extension member 40 has "U" patterns and "∩" patterns which are alternately disposed.

Unlike the exemplary embodiment, the extension member 40 may have "∧" patterns and "∨" patterns which are alternately disposed. Further, the extension member 40 may be formed in wave patterns.

In the exemplary embodiment, the patterns of "U" and "∩" are defined as bending patterns 41.

The extension member 40 has a slide protrusion 42 which protrudes outward in a radial direction to be inserted to the outer groove 12.

The slide protrusions 42 are formed by the number of outer grooves 12, and in the exemplary embodiment, three slide protrusions 42 are formed at intervals of 120°.

In addition, an extension locking portion 46 locked to the inclined end 36 is formed inside the extension member 40. Also, three extension locking portions 46 are formed at intervals of 120°.

The extension locking portions 46 protrudes inward in a radial direction.

Then, when the fixing member 30 rotates, the bending pattern 41 is pushed by the inclined surface 35 to be extended outward in the radial direction while being elastically deformed.

Herein, when the fixing member 30 rotates at a predetermined angle or more, the inclined end 36 and the extension locking portion 46 are locked to the each other.

The interlocking of the inclined end 36 and the extension locking portion 46 may suppress excessive rotation of the fixing member 30 and prevent the extension member 40 from being permanently deformed or broken.

Meanwhile, a stop ring 38 for preventing the separation of the extension member 40 may be coupled to the outside of the fixing member 30.

The extension member 40 is positioned between the fixing stopper 37 and the stop ring 38.

When at least one of the outer shaft 10 and the inner shaft 20 is rotated by the above coupling structure, the extension member 40 may be extended or contracted.

When the extension member 40 is extended, the inner shaft 20 and the outer shaft 10 are fixed.

When the extension member 40 is contracted, the outer shaft 10 and the inner shaft 20 may slide in a longitudinal direction.

Connection parts capable of connecting a plurality of pole shaft devices in multiple stages are installed at an upper side and a lower side of the outer shaft 10 of the exemplary embodiment.

In the exemplary embodiment, the connection parts are configured by an inner connection part 50 and an outer connection part 60.

The inner connection part 50 is coupled to the inner shaft 20 and the outer connection part 60 is coupled to the outer shaft 10.

The inner connection part 50 is inserted and engaged to the inner hollow 21 of the inner shaft 20.

An upper side of the inner connection part 50 is formed of a spherical ball hinge.

The outer connection part 60 includes a connection body 61 which is coupled to the outer hollow 11 of the outer shaft 10, a connection joint 62 which is inserted to the connection body 61 and rotatable at a predetermined angle with respect to the connection body 61, an inner support portion 63 which prevents the connection joint 62 from being separated from the connection body 61, and an outer support portion 64 which penetrates the connection joint 62, has the inner support portion 63 disposed therein, and is coupled to the connection body 61 to support the inner support portion 63.

A space to which the connection joint 62 is inserted to be rotated is concavely formed at the outside of the connection body 61.

The connection joint 62 is formed in a dumbbell shape in the exemplary embodiment.

Then, the connection joint 62 may be rotated while being inserted to the connection body 61.

Particularly, the connection joint 62 is formed in a ball hinge shape.

Other pole shaft devices may be coupled to each other through the connection joint 62.

The connection joint 62 is configured by a first ball hinge 65 and a second ball hinge 66.

A coupling groove 67 for being coupled to other components is formed in the first ball hinge 64 and a thread is formed therein.

A coupling groove 68 is formed even on the second ball hinge 66 and the coupling groove 68 is formed in a lateral direction.

The inner support portion 63 has a groove 63*a* formed at a side portion so that the connection joint 62 may be inserted.

Also, the outer support portion 64 has a groove 64*a* formed at a side portion so that the connection joint 62 may be inserted.

The grooves 63*a* and 64*a* of the inner support portion 63 and the outer support portion 64 communicate with each other.

The connection joint 62 may be rotated to be inserted to the grooves 63*a* and 64*a*.

When the connection joint 62 is inserted to the grooves 63*a* and 64*a*, the connection joint 62 is locked to the inner support portion 63 and the outer support portion 64 to limit the rotation in a lateral direction.

The outer support portion 64 is screw-coupled to the connection body 61.

Herein, the inner connection part 50 is replaced with a part corresponding to the connection joint 62, thereby connecting the pole shaft devices according to the exemplary embodiment in multiple stages.

Exemplary embodiments of the present invention have been described with reference to the accompanying drawings, but the present invention is not limited to the exemplary embodiments and may be prepared in various forms, and it will be understood by a person with ordinary skill in the art, to which the present invention pertains, that exemplary embodiments of the present invention may be implemented in other specific forms without modifying the technical spirit or essential feature of the present invention. Therefore, it should be understood that the aforementioned exemplary embodiments are illustrative in terms of all aspects and are not limited.

The invention claimed is:

1. A pole shaft device, comprising:

an outer shaft (10);

an inner shaft (20) which is disposed in the outer shaft (10) and slides along the inside of the outer shaft (10);

an outer groove (12) formed on an inner surface of the outer shaft (10) in a longitudinal direction;

a fixing member (30) which is fixed on the inner shaft (20) and has at least one inclined surface (35) formed in the circumferential direction thereof; and an extension member (40) which is coupled to the outer shaft (10) so as to be movable in the longitudinal direction thereof and extended by friction with the inclined surface so as to fix the outer shaft (10) and the inner shaft (20), wherein the extension member (40) includes:

a slide protrusion (42) slidably coupled to the outer groove (12) formed in the longitudinal direction of the outer shaft (10); and an extension locking portion (46) that protrudes inward in a radial direction and interlocks with an inclined end (36), wherein the extension member (40) is formed with a bending pattern (41) formed by bending in a vertical direction, and wherein the slide protrusion (42) of the extension member (40) is inserted to the outer groove (12) such that the extension member (40) interlocks with the outer groove (12) in a circumferential direction and does not rotate.

2. The pole shaft device of claim 1, wherein the fixing member (30) includes:

a fixing body (32);

an inner fixing portion (34) which is formed in the fixing body (32), inserted to an inner hollow (21), and coupled with the inner shaft (20); and the at least one inclined surface (35) which is formed in the fixing body (32), formed in the circumferential direction thereof, installed with the extension member (40), and interferes with the extension member (40) during rotation to press the extension member (40).

3. The pole shaft device of claim 2, further comprising:

a stop ring (38) which is installed on the fixing member (30) and prevents the extension member (40) from moving in the longitudinal direction to prevent the extension member (40) from being separated from the fixing member (30).

4. The pole shaft device of claim 2, wherein the at least one inclined surface (35) is a plurality and are formed, an inclined end (36) is between the inclined surfaces (35), the inclined end (36) has a height difference, and the extension member (40) interlocks with the inclined end (36) when the fixing member (30) rotates.

* * * * *